US007189072B2

(12) United States Patent
Matsuyama

(10) Patent No.: US 7,189,072 B2
(45) Date of Patent: Mar. 13, 2007

(54) APPARATUS FOR CONTROLLING A FLAME

(76) Inventor: Susumu Matsuyama, 2005 Palmetto Dunes, Duluth, GA (US) 30097

( * ) Notice: Subject to any disclaimer, the term of this patent is extended or adjusted under 35 U.S.C. 154(b) by 70 days.

(21) Appl. No.: 10/890,342

(22) Filed: Jul. 13, 2004

(65) Prior Publication Data

US 2004/0259046 A1 Dec. 23, 2004

Related U.S. Application Data

(63) Continuation-in-part of application No. 10/336,316, filed on Jan. 3, 2003, now Pat. No. 6,896,510.

(51) Int. Cl.
*F23D 3/18* (2006.01)
*F23D 3/08* (2006.01)

(52) U.S. Cl. ..... 431/302; 431/322; 431/319; 431/325

(58) Field of Classification Search ..... 431/298, 431/302, 319, 195–205, 203, 204, 218, 325, 431/206, 11, 12, 303, 322
See application file for complete search history.

(56) References Cited

U.S. PATENT DOCUMENTS

| | | | | | |
|---|---|---|---|---|---|
| 217,895 | A * | 7/1879 | Muller | 431/302 |
| 240,711 | A * | 4/1881 | Hinrichs et al. | 431/302 |
| 454,686 | A * | 6/1891 | Richmond | 431/308 |
| 463,277 | A * | 11/1891 | Harris | 431/325 |
| 479,350 | A * | 7/1892 | Cooper | 431/319 |
| 954,422 | A * | 4/1910 | Conrath | 431/319 |
| 1,278,388 | A * | 9/1918 | Sadlo | 431/324 |
| 2,183,273 | A * | 12/1939 | Baker | 431/196 |
| 2,284,568 | A * | 5/1942 | Garber | 431/196 |
| 2,480,772 | A * | 8/1949 | Riemenschneider | 431/153 |
| 4,363,620 | A * | 12/1982 | Nakamura et al. | 431/33 |
| 4,580,970 | A * | 4/1986 | Harada | 431/302 |
| 5,080,578 | A * | 1/1992 | Josephs et al. | 431/33 |
| 5,551,866 | A * | 9/1996 | Josephs et al. | 431/153 |
| 6,896,510 | B2 * | 5/2005 | Matsuyama | 431/284 |

* cited by examiner

*Primary Examiner*—Josiah C. Cocks
(74) *Attorney, Agent, or Firm*—Thomas, Kayden, Horstemeyer & Risley, LLP

(57) ABSTRACT

An apparatus for producing a sustained flame, comprising: an inner wick with a hollow center; an outer wick disposed around the inner wick, wherein the region between the inner wick and the outer wick defines an inter-wick region, and wherein the region around the outer wick defines an outer wick peripheral region; at least one fuel reservoir, for containing a flame-fueling liquid, in communication with at least one of the wicks; a first air container; a first air channel connecting the first air container to the center of the inner wick; and a second air container.

13 Claims, 12 Drawing Sheets

APPARATUS FOR CONTROLLING A FLAME

CROSS REFERENCE TO RELATED APPLICATION

This application is a continuation-in-part of application Ser. No. 10/336,316, now U.S. Pat. No. 6,897,316 B2, which was filed Jan. 3, 2003.

FIELD OF THE INVENTION

The present invention relates to apparatus for controlling a flame.

BACKGROUND

Some fuels burned by oil lamps produce relatively large amounts of smoke, but are still in use because they have other beneficial properties. For example, citronella oil produces smoke but is useful for repelling insects. Although a citronella lamp user can avoid the buildup of smoke by extinguishing the lamp for a period of time and then relighting it, this is undesirable because it extinguishes the light source. Although the amount of light produced by citronella oil is less than other types of liquid fuels, it is nonetheless convenient to have this light source and many users find the pink colored flame to be attractive.

Air drafts around the flame tend to increase the amount of smoke produced, so some existing lamps provide a shield around the flame to protect from drafts. However, shielding the flame from drafts can result in an inadequate air supply to the flame. This inadequate air supply results in incomplete combustion, which also tends to increase the amount of smoke produced.

SUMMARY

An apparatus for producing a sustained flame is provided. One embodiment, among others, comprises: an inner wick; an outer wick disposed around the inner wick; at least one fuel reservoir; a first air container; a first air channel; and a second air container. The inner wick has a hollow center. The region between the inner wick and the outer wick defines an inter-wick region, and the region around the outer wick defines an outer wick peripheral region. The fuel reservoir is in communication with at least one of the wicks. The first air channel connects the first air container to the center of the inner wick

DESCRIPTION OF THE DRAWINGS

Many aspects of the invention can be better understood with reference to the following drawings. The components in the drawings are not necessarily to scale, emphasis instead being placed upon clearly illustrating the principles of the present invention.

DETAILED DESCRIPTION

Figure 1:
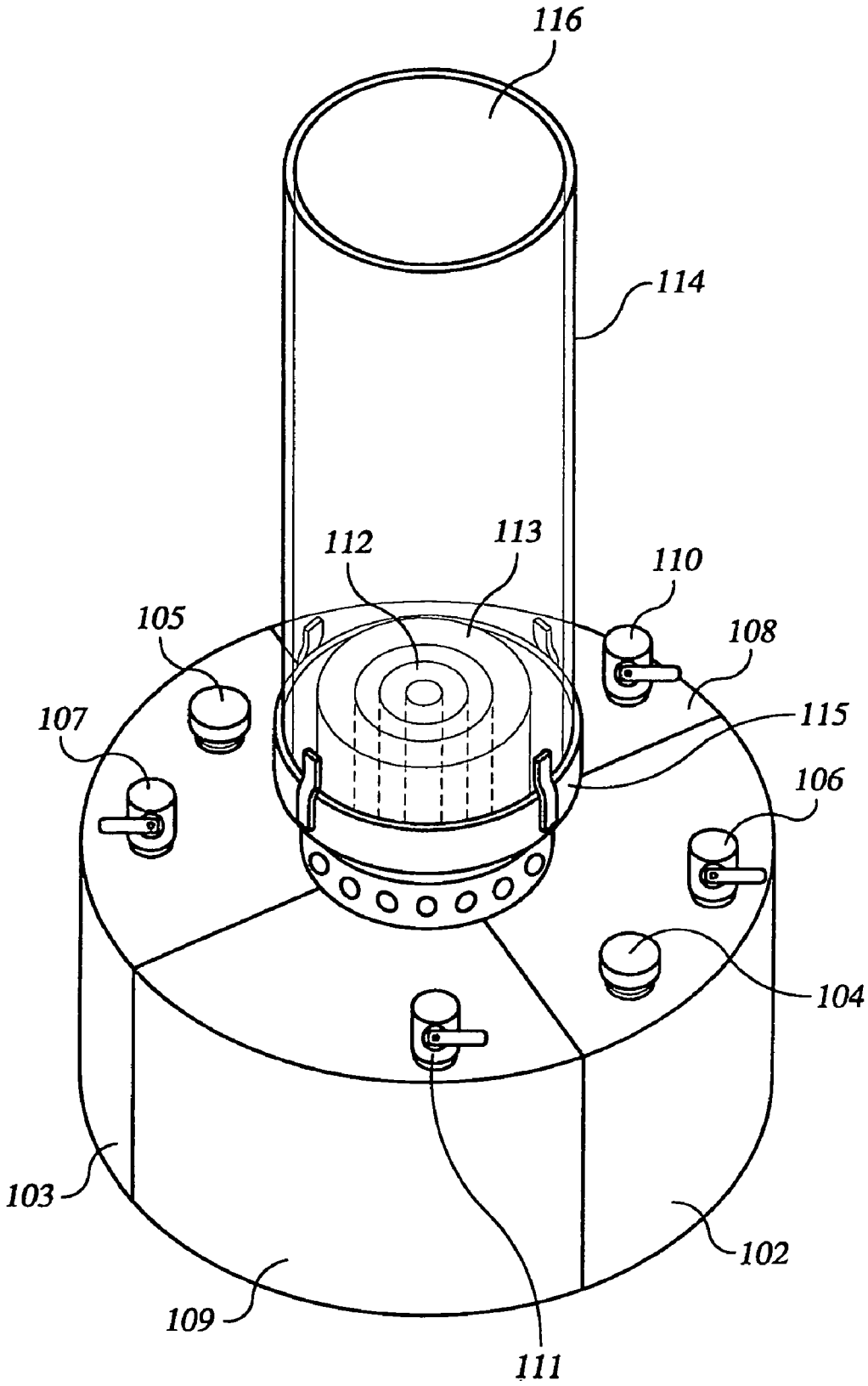
FIG. 1 is a perspective view of an exemplary embodiment of an apparatus for controlling a flame.

FIG. 1 is a perspective view of an exemplary embodiment of an apparatus for controlling a flame. The apparatus includes: fuel reservoirs 102 and 103; caps 104 and 105; fuel valves 106 and 107; air containers 108 and 109; air valves 110 and 111; wicks 112 and 113; shield 114; and collar 115.

The fuel reservoirs 102, 103 contain liquid fuel, for example, liquid paraffin, mineral oil, citronella oil, or a variety of other suitable fuels. In one embodiment, the fuels contained in fuel reservoirs 102, 103 are different, so that the color characteristics of the flames may be different. Caps 104, 105 allow the fuel reservoirs 102, 103 to be filled, and also seal to prevent air from entering fuel reservoirs 102, 103 through the cap opening. In one embodiment, caps 104, 105 are safety caps to prevent buildup of excess vapor pressure. Each fuel valve 106, 107 is in fluid communication with one of the fuel reservoirs 102, 103, so that when fuel valve 106, 107 is open, ambient air flows into fuel reservoirs 102, 103.

Each fuel reservoir 102, 103 is in liquid communication with one of the wicks 112, 113. The wicks 112, 113 may be made of any suitable material, such as glass fiber or metal mesh, as long as the wick draws liquid fuel from the fuel reservoir.

Each air valve 110, 111 is in fluid communication with an air container 108, 109, so that when air valve 110, 111 is open, atmospheric air flows into air container 108, 109. Air flows from air container 108, 109 to the flame-bearing end of a corresponding wick 112, 113. Supplying air through a container provides a regulated and continuous flow of air to the flame, reducing the effect of any air currents or turbulence around the apparatus.

The exemplary embodiment may also include a shield 114 surrounding wicks 112, 113, and a collar 115, which fastens shield 114 to the fuel reservoirs 102, 103 and/or air containers 108, 109. Shield 114 acts to prevent a user from coming into direct contact with the flame, and also to prevent air drafts from affecting the flame. Shield 114 has an aperture 116 to allow exhaust gases to escape from the apparatus. The aperture of a conventional lamp must be relatively large in order to provide an adequate air supply to the flame, but aperture 116 can be relatively small because the apparatus supplies air to the vicinity of the flame through an air channel (see FIG. 2). A small aperture may be desired because it prevents air drafts from extinguishing the flame.

Figure 2:
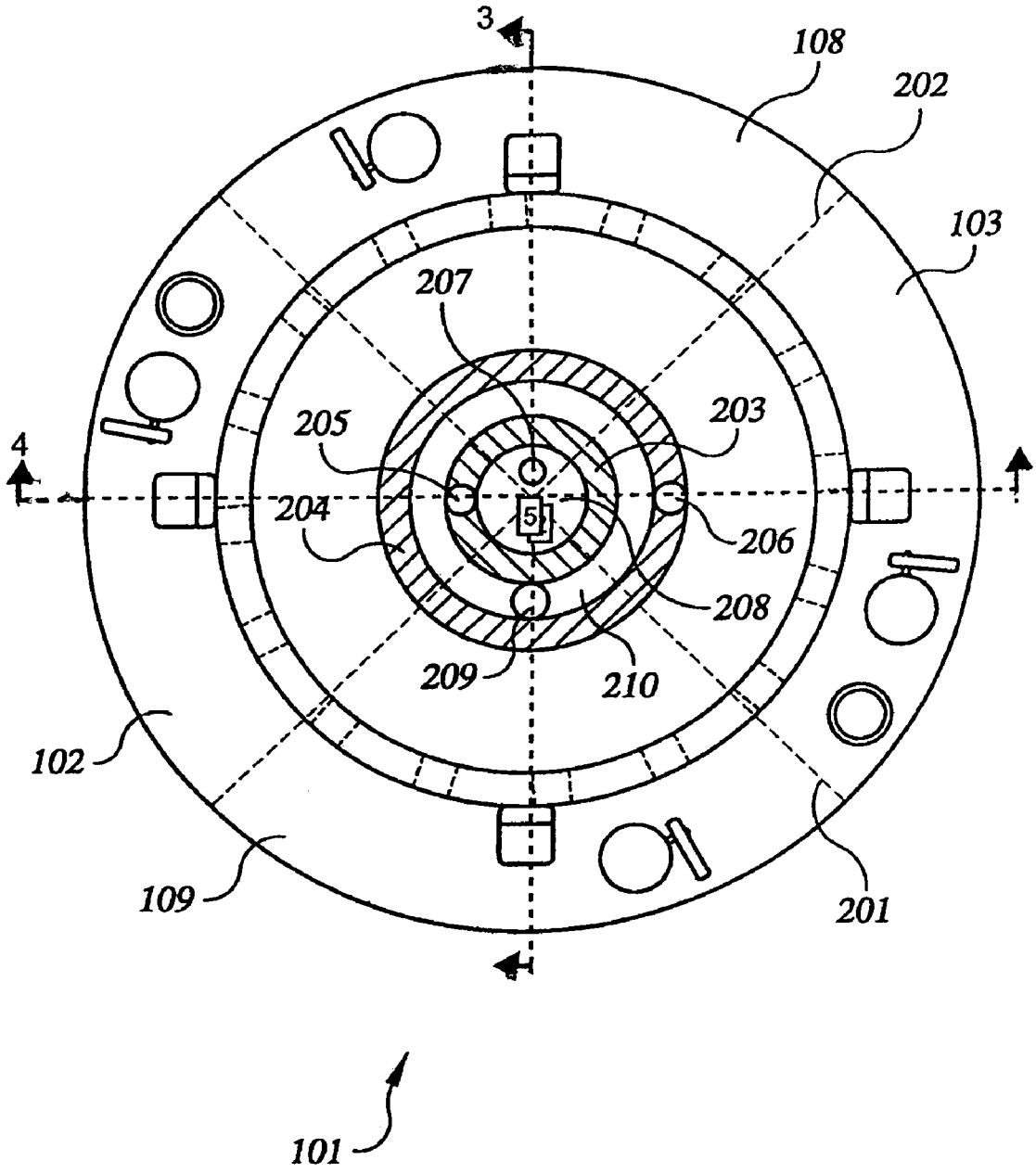
FIG. 2 is a top view of the apparatus of FIG. 1.

FIG. 2 is a top view of the apparatus of FIG. 1. In one embodiment, fuel reservoirs 102 and 103 and air containers 108 and 109 are separate pie-shaped pieces arranged to form a substantially circular base 101. In an alternative embodiment, fuel reservoirs 102 and 103 and air containers 108 and 109 are instead portions of substantially circular base 101, formed by separation walls 201 and 202 inside one-piece base 101.

In this exemplary embodiment, wicks 112, 113 (see FIG. 1) are concentrically disposed atop the base 101 at wick receiving areas 203 and 204, respectively. can be made of, for example, a tubular form of cotton/glass fiber. A portion of each wick 112, 113 is in fluid communication with fuel reservoirs 102, 103 through openings 205, 206 in fuel reservoirs 102, 103. Wick 112 is supplied with air from air container 108, through opening 207 in air container 108, which opens into air channel 208 in the hollow center of the first wick 112. Wick 113 is supplied with air from air container 109, through opening 209 in air container 109, which opens to air channel 210 in the space between the inner and outer wicks 112 and 113.

Figure 3:
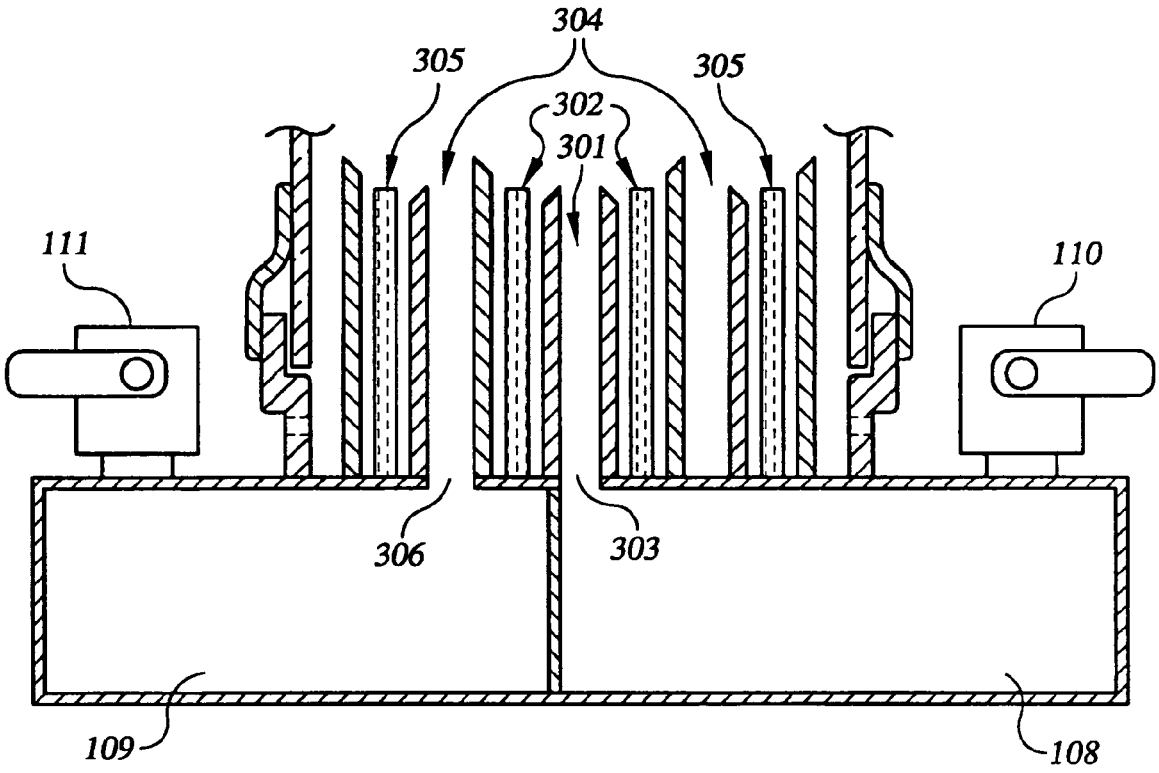
FIG. 3 is a partial side cutaway view of the apparatus of FIG. 2.

FIG. 3 is a partial side cutaway view of the apparatus of FIG. 2. In this view, air containers 108, 109 are visible, but fuel reservoirs 102, 103 are not. Air channel 208 (FIG. 2) has a first end 301 located near the flame-bearing end 302 of wick 112, and a second end 303 located in air container 108. Air channel 210 (FIG. 2) has a first end 304 located near the flame-bearing end 305 of wick 113, and a second end 306 located in air container 109.

When air is allowed to flow freely through air channels 208 and 210, each of the wicks 112, 113 produces a distinct and separate flame at its flame-bearing ends 302, 305. Flames with different characteristics can be produced by using different fuels in fuel reservoirs 102, 103. One characteristic that varies with the type of fuel is the flame color: liquid paraffin produces a yellow flame; citronella oil produces pink; oil blended with copper salts produces green or blue; oil blended with lithium salts produces red. These flame colors can be manipulated by controlling the flow of air through air channels 208 and 210.

When airflow through air channel 208 to center of wick 112 is reduced, the color of the flame on wicks 112 and 113 is unaffected, but the size of the flame on wick 112 is decreased. When airflow through air channel 210 to the area between wicks 112 and 113 is reduced, the inner flame on wick 112 is unaffected, but the outer flame on wick 113 migrates from the outer edge of the wick and begins to merge with the inner flame on wick 112. As airflow through air channel 210 decreases further, the flame-bearing end 305 of wick stops burning, though the area in between wicks 112 and 113 still contains hot gases which are a product of fuels from both fuel reservoirs 102, 103. At this point, the inner flame on wick 112 is of a single color but the color of the merged flame in the area surrounding the inner flame is a blend of colors, a result of the mixture of fuels in this area.

In the embodiment illustrated in FIG. 3, the airflow through air channels 208 and 210 is reduced using air valves 110 and 111. However, other mechanisms may be used to control airflow.

Figure 4:
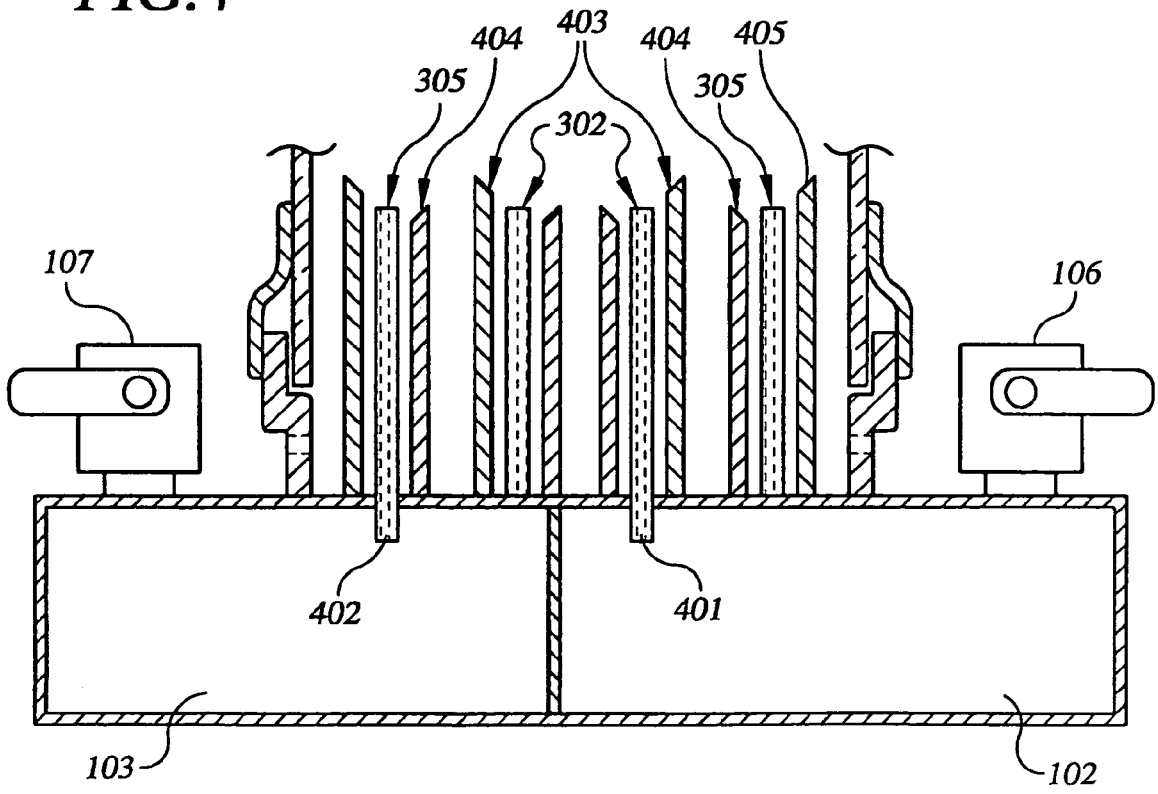
FIG. 4 is a partial front cutaway view of the apparatus of FIG. 2.

FIG. 4 is a partial front cutaway view of the apparatus of FIG. 2. In this view, fuel reservoirs 102, 103 are visible, but air containers 108, 109 are not. A portion of wick 112, comprising a second end 401, extends into fuel reservoir 102. Similarly, a portion of wick 113, comprising second end 402, extends into fuel reservoir 103. Fuel valves 106, 107 control the flow of air from the atmosphere into fuel reservoirs 102, 103.

The fuel flows generally as follows: wicks 112, 113 utilize the surface tension of the liquid fuel to draw it up through the fibers of the wick by capillary action. When the wick 112, 113 burns fuel at its flame bearing end 302, 305, an equal amount is drawn up the wick 112, 113 from fuel reservoir 102, 103 to replenish the burned fuel. In normal operation, fuel valves 106, 107 are open, so that air flows from the atmosphere into fuel reservoir 102, 103 to fill the void left by the burned fuel.

In another mode of operation, fuel valves 106, 107 are closed so that air is unable to flow into fuel reservoir 102, 103 to fill the void left by the burned fuel. In this mode, the internal pressure in fuel reservoir 102, 103 is reduced as the fuel burns. This reduced internal pressure resists the capillary action of the wick. When the reduced internal pressure is great enough to overcome the capillary action, liquid fuel is no longer drawn up the wick 112, 113 to replenish the burned fuel. At this point, the flame will diminish in size as the fuel already in the wick is burned, until that fuel runs out and the flame is finally extinguished. Thus, closing fuel valve 106 on fuel reservoir 102 will result in the flame of wick 112 being extinguished, while closing fuel valve 107 on fuel reservoir 103 will result in the flame of wick 113 being extinguished. If fuel valve 106 or 107 is reopened, then the corresponding wick will reignite after a period of time, unless both fuel valves 106 and 107 have been closed.

In the exemplary embodiment illustrated in FIG. 4, the apparatus also includes wick sleeves 403, 404 to carry wicks 112, 113. In one embodiment, the wick sleeves 403, 404 are shaped to closely conform to the wicks 112, 113. Wick sleeves 403, 404 prevent expansion of the flame to the lower part of the wicks 112, 113, and increase the capillary pressure on wicks 112, 113. Wick sleeves 403, 404 may be made of a heat-conductive material, for example, copper or glass, to lower the viscosity of the liquid fuel. In one embodiment, the wick sleeves 403, 404 are made of glass tubing and have an angled edge 405 at the end corresponding to the flame-bearing end 302, 305 of the wick. This angled edge 405 aids in the insertion and removal of the wick 112, 113, and also reduces flow of liquid fuel down the side of wick sleeves 403, 404 and into air containers 108, 109.

Figure 5:
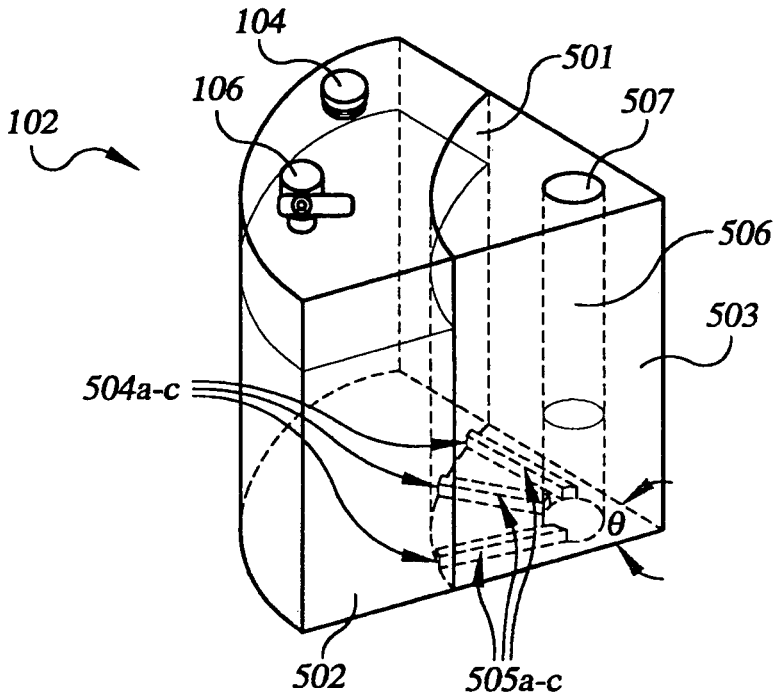
FIG. 5 is a prespective view of the fuel reservoir section 102

FIG. 5 is a prespective view of the fuel reservoir section 102. The angle θ can be varied to produce reservoirs of various number and capacities. Wall 501 divides fuel reservoir 102 into a first portion 502 and a second portion 503. The fuel reservoir 102 is fillable with liquid fuel through cap 104, which is in fluid communication with first portion 502. Fuel valve 106, also in fluid communication with first portion 502, controls the flow of air from the atmosphere into fuel reservoir 102, as described with regard to FIG. 4. At least one perforation 504*a–c* in wall 501 allows fuel to communicate between first portion 502 and second portion 503. The fuel end 401 of the wick 112 is located in second portion 503, such that it makes contact with liquid fuel flowing into second portion 503.

In the exemplary embodiment, first portion 502 is hollow, and second portion 503 is solid, except for at least one first channel 505*a–c* and a second channel 506 connecting to first channels 505*a–c*. Use of a solid central portion strengthens the base 101 (see FIG. 2). The open end 507 of second channel 506 lines up with opening 205 (see FIG. 2) in the base 101.

First channels 505*a–c* are aligned with perforations 504*a–c* so that liquid fuel contained in first portion 502 flows through perforations 504*a–c* into first channels 505*a–c*, and from there flows into second channel 506. Perforations 504*a–c* provide an air-tight seal around first channels 505*a–c*. The fuel end 401 of the wick 112 is located in second channel 506 such that it makes contact with liquid fuel flowing into second channel 506. In this embodiment, first channels 505*a–c* are substantially aligned along a horizontal axis and second channel 506 is substantially aligned along a vertical axis, but embodiments can include any alignment that allows the liquid fuel to flow from first portion 502 into second channel 506.

Figure 6:
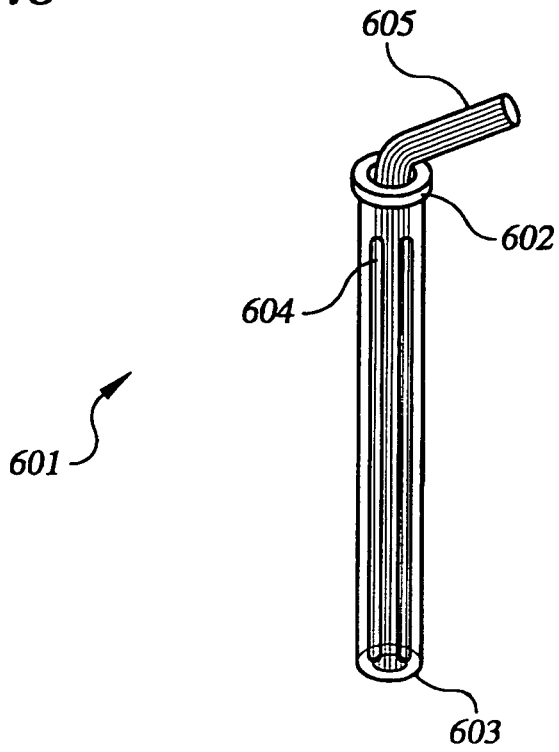
FIG. 6 illustrates a wick holder which can be used in conjunction with an embodiment of an apparatus for controlling a flame.

FIG. 6 illustrates a wick holder 601 which can be used in conjunction with the fuel reservoir illustrated in FIG. 5. In this embodiment, wick holder 601 fits into second channel 506 (see FIG. 5). Wick holder 601 is tubular, with an open end 602 which aligns with hole 205 (see FIG. 2) when placed in second channel 506 (see FIG. 5), and a closed end 603. At least one slit 604 in wick holder 601 allows liquid fuel to flow from vertical channel 506 (see FIG. 5) into fuel end 401 (see FIG. 4) of wick 112 (see FIG. 4), and from there liquid fuel travels to flame bearing end 302 (see FIG. 4) via capillary action. Wick holder 601 can be made of any suitable material such as metal or glass.

Figure 7:
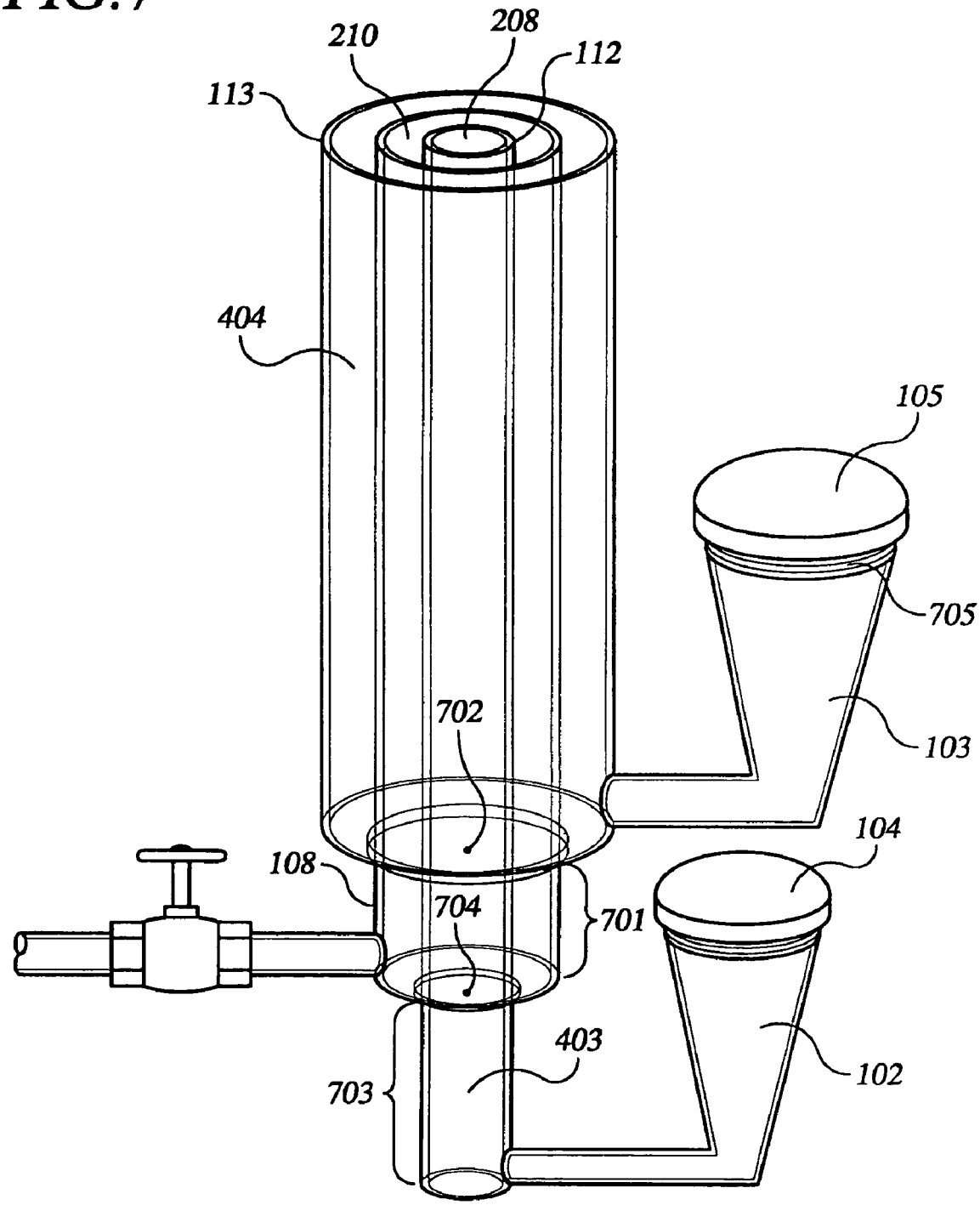
FIG. 7 is a perspective view of another embodiment of an apparatus for controlling a flame.

FIG. 7 is a perspective view of another embodiment of an apparatus for controlling a flame. Inner wick 112 and outer wick 113 are concentrically arranged, with an air channel 210 disposed between them. An additional air channel 208 is disposed in the approximate center of the inner wick 112. An inner wick sleeve 403 surrounds one surface of inner wick 112. An outer wick sleeve 404 surrounds one surface of outer wick 113. Fuel reservoirs 102, 103 are in fluid communication wicks 112 and 113.

In the example embodiment, the apparatus consists of several nested pieces. Wick sleeves 403 and 404 are substantially tubular in shape, and wicks 112 and 113 are shaped like hollow cylinders. Another tubular piece, air container 108, is disposed between outer wick 112 and inner wick 113, forming air channel 210 between the wall of air container 108 and the outer surface of inner wick 112.

In the example embodiment, wick sleeves 403, 404 and air container 108 are each of different lengths. The length of air container 108 is such that when air container is placed inside outer wick sleeve 404 and their tops are substantially aligned, a portion 701 of air container 108 extends through opening 702 in outer wick sleeve 404. Similarly, the length of inner wick sleeve 403 is such that when inner wick sleeve 403 is placed inside air container 108 and their tops are substantially aligned, a portion 703 of inner wick sleeve 403 extends through opening 704 in air container 108.

Fuel reservoirs 102, 103 are in fluid communication with wick sleeves 403, 404. In the exemplary embodiment, fuel reservoirs 102, 103 are an integrated part of wick sleeves 403, 404, but in another embodiment fuel reservoirs 102 and 103 are separate pieces connected to wick sleeves 403, 404. Caps 104, 105 allow fuel reservoirs 102, 103 to be filled.

In addition, threads 705 on the exemplary embodiment allow caps 104, 105 to regulate the flow of air into fuel reservoirs 102, 103. When cap 104, 105 is in a tightly closed position, the pressure inside fuel reservoir 102, 103 is reduced as fuel is burned, and this reduced pressure resists the capillary action of wick 112, 113, so that finally the wick stops drawing fuel and the flame is extinguished. When cap 104, 105 is not tightly closed, air flows into fuel reservoir 102, 103 as fuel is burned so that pressure is not reduced and the capillary action of wick 112, 113 continues. While threads 705 in cap 104, 105 are used in the exemplary embodiment, any mechanism which regulates the flow of air into fuel reservoirs 102, 103 could be used instead.

Figure 8:
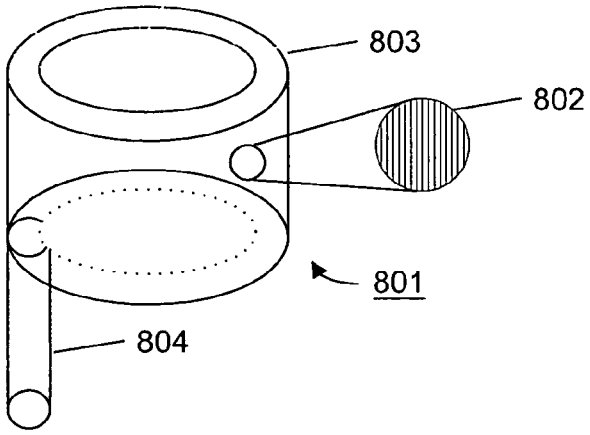
FIG. 8 is a perspective view of an exemplary wick.

FIG. 8 is a perspective view of an exemplary wick 801 containing fibers 802 (shown in close-up). The wick 801 may be made of any suitable material that draws liquid fuel from the fuel reservoir. Typically, glass fibers are used to form a wick, as these fibers withstand high temperatures. In this embodiment, glass fibers with a relatively fine diameter are woven together and compressed to form a wick 801 with a main body 803 and a tail section 804. In this embodiment, the main body 803 of the wick is a hollow cylinder, with a circular cross-section. In other embodiments, the hollow main body 803 is rectangular or triangular in cross-section. wick fibers run parallel to the body of the wick Tail section 804 is in contact with a lower portion of main body 803. Fluid in contact with the lower portion of tail section 804 is absorbed by tail section 804. Through capillary action, fluid spreads to the lower portion of main body 803, where tail section 804 makes contact with main body 803. Capillary action also causes the fluid to spread to the remaining portions of main body 803. In one embodiment, tail section 804 is a separate wick. In another embodiment, tail section 804 is part of wick 801 rather than a separate piece.

Figure 9:
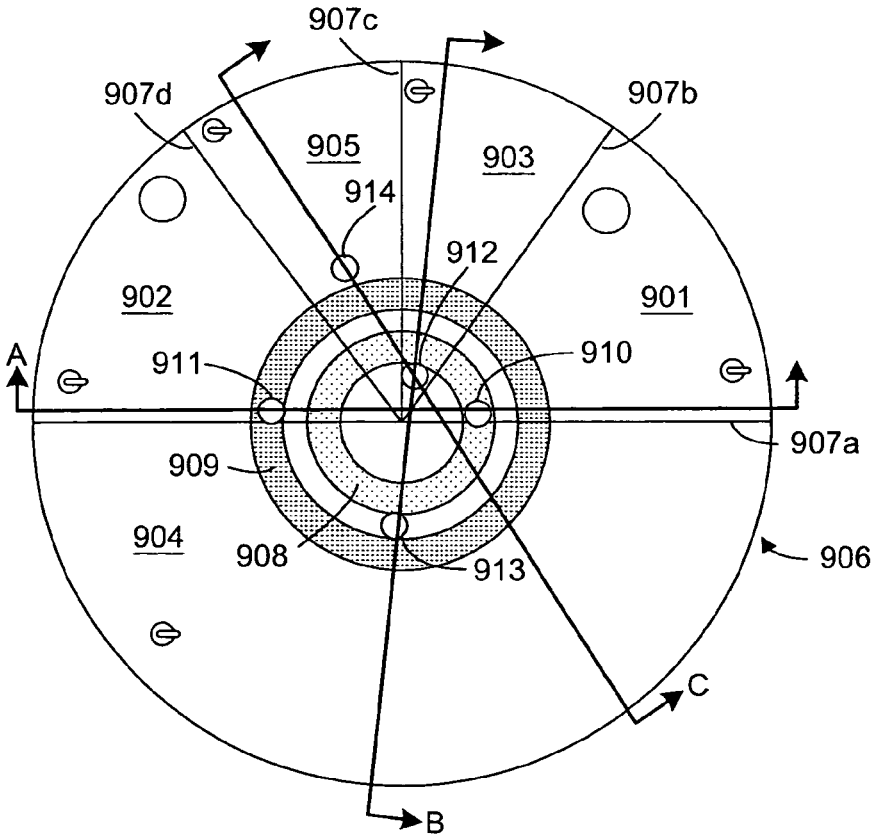
FIG. 9 is a top view of another embodiment of the apparatus for controlling a flame.

FIG. 9 is a top view of another embodiment of the apparatus for controlling a flame. In this embodiment, fuel reservoirs 901 and 902 and air containers 903, 904, and 905 are all portions of substantially circular base 906, formed by separation walls 907*a–d* inside base 906. In another embodiment, fuel reservoirs 901 and 902 and air containers 903, 904, and 905 are separate pie-shaped pieces arranged so that together the pieces form a substantially circular base.

Two receiving areas 908 and 909 are shown on top of base 906. Each wick 801A, 801B (not visible in this view; see FIGS. 8 and 10) is positioned on one of the receiving areas 908, 909, with tail section 804 (see FIG. 8) protruding into fuel reservoir 901, 902 through an opening 910, 911. Air flows from air containers 903, 904, and 905 through openings 912, 913, and 914, allowing control over the supply of air to wicks 801A, 801B.

Figure 10A:
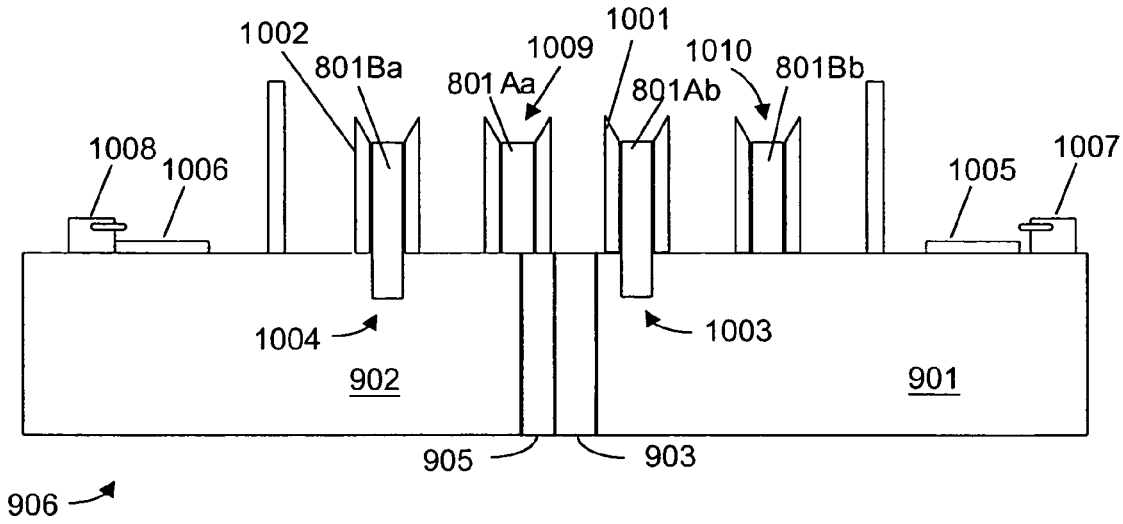
FIG. 10A is a cutaway sectional view of the apparatus of FIG. 9, through sectional A.

FIG. 10A is a cutaway sectional view of the apparatus of FIG. 9, through sectional A. In this cutaway view, each cylindrical wick 801A, 801B appears as two separate halves (801Aa and 801Ab; 801Ba and 801Bb). Inner wick 801A is positioned near the center of base 906, and outer wick 801B is positioned outside inner wick 801A.

The inner and outer surfaces of each wick are partially surrounded by a wick sleeve 1001, 1002. Wick sleeves 1001, 1002 prevent expansion of the flame to the lower part of wicks 801A, 801B, and increase capillary pressure on wicks 801A, 801B. In one embodiment, wick sleeves 1001, 1002 closely conform to wicks 801A, 801B. Together, a wick and wick sleeve form a wick assembly.

One end 1003 (tail section 804 from FIG. 8) of inner wick 801A extends into fuel reservoir 901 through opening 910 (FIG. 9). Similarly, one end 1004 of outer wick 801B (tail section 804 from FIG. 8) extends into fuel reservoir 902 through opening 911 (FIG. 9). Each fuel reservoir 901, 902 is fillable with liquid fuel through caps 1005, 1006. Air valves 1007 and 1008 control the flow of air from the atmosphere into fuel reservoirs 901 and 902.

The fuel flows generally as follows: each wick 801A, 801B utilizes the surface tension of the liquid fuel to draw fuel up through the fibers of the wick. This effect is known as capillary action. When the wick 801A, 801B burns fuel at its flame bearing end 1009, 1010, an equal amount is drawn up the wick 801A, 801B from fuel reservoir 901, 902 to replenish the burned fuel. In normal operation, air valves 1007, 1008 are open, so that air flows from the atmosphere into fuel reservoir 901, 902 to fill the void left by the burned fuel.

In another mode of operation, air valves 1007, 1008 are closed so that air is unable to flow into fuel reservoir 901, 902 to fill the void left by the burned fuel. In this mode, the internal pressure in fuel reservoir 901, 902 is reduced as the fuel burns. This reduced internal pressure resists the capillary action of the wick. When the reduced internal pressure is great enough to overcome the capillary action, liquid fuel is no longer drawn up the wick 801A, 801B to replenish the burned fuel. At this point, the flame will diminish in size as the fuel already in the wick is burned, until that fuel runs out and the flame is finally extinguished. Thus, closing air valve 1007 on fuel reservoir 901 will result in the flame of wick 801A being extinguished, while closing air valve 1008 on fuel reservoir 902 will result in the flame of wick 801B being extinguished. If one of the air valves 1007, 1008 is reopened, then the corresponding wick will reignite after a period of time, unless both air valves 1007 and 1008 have been closed.

Figure 10B:
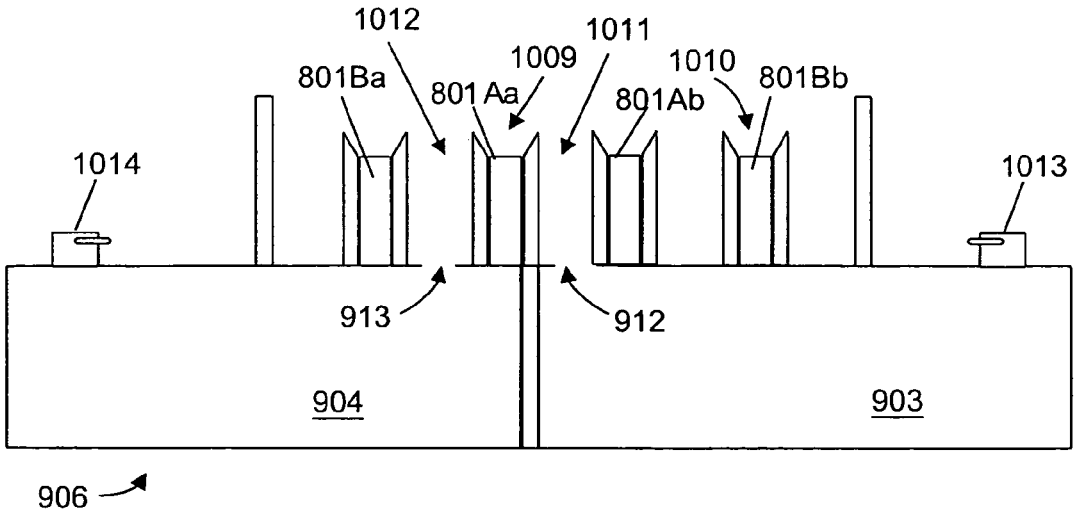
FIG. 10B is a cutaway sectional view of the apparatus of FIG. 9, through sectional B.

FIG. 10B is a cutaway sectional view of the apparatus of FIG. 9, through sectional B. In this sectional view, openings 912 and 913 from FIG. 9 are visible. An air channel 1011 extends between opening 912 in central air container 903 and the center of the flame-bearing end 1009 of inner wick 801A. An air channel 1012 extends between opening 913 in inter-wick air container 904 and the flame-bearing end 1010 of outer wick 801B, between wicks 801A and 801B.

When air is allowed to flow freely through air channel 1011 and air channel 1012, each of the wicks 801A, 801B produces a distinct and separate flame at its flame-bearing end 1009, 1010. Flames with different characteristics can be produced by using different fuels in fuel reservoirs 901 and 902. One characteristic that varies with the type of fuel is the flame color: liquid paraffin produces a yellow flame; citronella oil produces pink; oil blended with copper salts produces green or blue; oil blended with lithium salts produces red. These flame colors can be manipulated by controlling the flow of air through air channel 1011 and air channel 1012.

When airflow through air channel 1011 to center of inner wick 801A is reduced, the color of the flame on wicks 801A and 801B is unaffected, but the size of the flame is decreased. When airflow through air channel 1012 to the area between wicks 801A and 801B is reduced, the flame on inner wick 801A is unaffected, but the flame on outer wick 801B migrates from the outer edge of the wick and begins to merge with the flame on inner wick 801A. As airflow through air channel 1012 decreases further, the flame-bearing end 1010 of outer wick 801B stops burning, though the area in between wicks 801A and 801B still contains hot gases which are a product of fuels from both fuel reservoirs 901 and 902. At this point, the flame on inner wick 801A is of a single color but the color of the merged flame in the area surrounding the inner flame is a blend of colors, a result of the mixture of fuels in this area.

In the embodiment illustrated in FIG. 10, the airflow through air channel 1011 and air channel 1012 is controlled using air valves 1013 and 1014. However, other mechanisms may be used to control airflow. In one embodiment, a moveable collar (not shown) surrounds at least some vertical portion of the wicks, allowing control of airflow to the area around the wicks. In another embodiment, one or more of the air containers has a drain (not shown) located on its exterior surface in the bottom region. This drain can be opened to allow any fuel dripping into the air container through holes 912, 913, or 914 to drain.

Figure 10C:
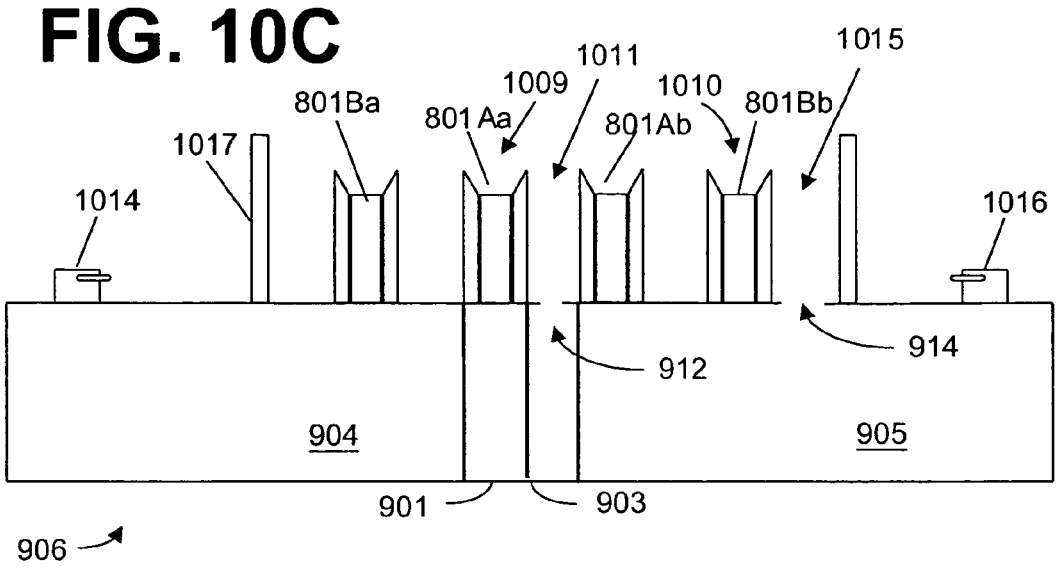
FIG. 10C is a cutaway sectional view of the apparatus of FIG. 9, through sectional C.

FIG. 10C is cutaway sectional view of the apparatus of FIG. 9, through sectional C. Air channel 1011 is visible in this view as well as in FIG. 10B. Air channel 1015 (not visible in FIG. 10B) extends from opening 914 of outer air container 905 to the flame-bearing end 1010 of outer wick 801B, in the area outside the periphery of outer wick 801B. In the embodiment illustrated in FIG. 10C, the airflow through air channel 1015 is controlled using air valve 1016. However, other mechanisms may be used to control airflow.

Collar 1017 can be used with the apparatus to reduce airflow to the flame-bearing end 1010 of outer wick 801B. (The details of collar 1017 will be discussed in connection with FIGS. 15A & B.) When collar 1017 is used to limit air from outside and air channels 1011 and 1012 are open, these two channels supply enough oxygen to outer wick 801B so that its flame will not be extinguished. However, when air channels 1011 and 1012 are closed, air channel 1015 can be opened to supply outer wick 801B with oxygen. Air channel 1015 can also be opened along with air channels 1011 and 1012, which improves combustion efficiency and produces less smoke.

Figure 11A:
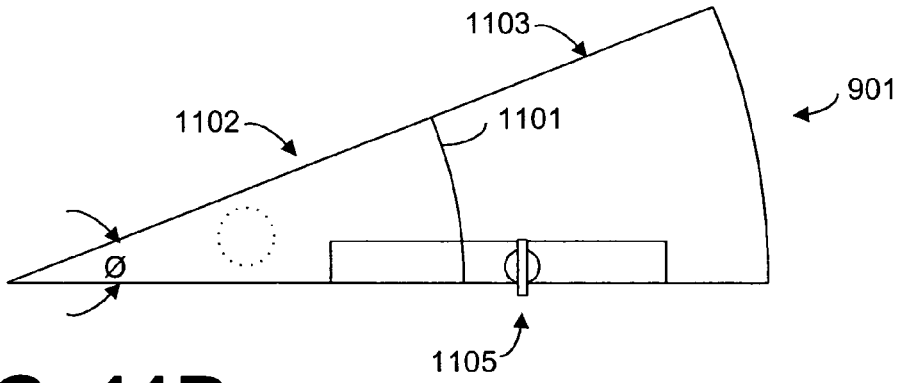
FIGS. 11A and 11B are side and bottom views of a fuel reservoir used in one embodiment of the apparatus for controlling a flame.
Figure 11B:
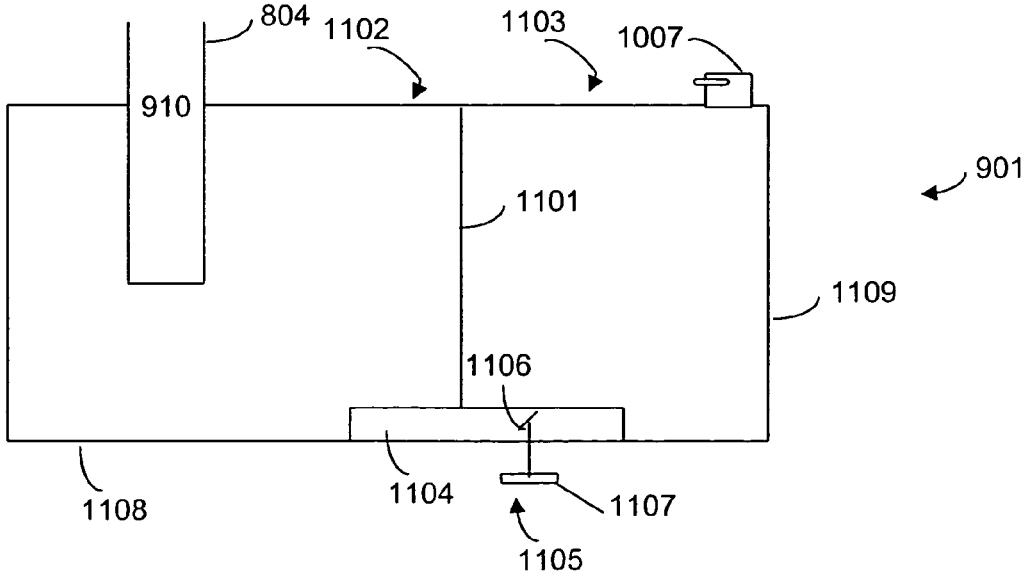

FIGS. 11A and 11B are side and bottom views of a fuel reservoir used in one embodiment of the apparatus for controlling a flame. Wall 1101 divides fuel reservoir 901 into a first portion 1102 and a second portion 1103. Air valve 1007, which is in fluid communication with second portion 1103, controls the flow of air from the atmosphere into fuel reservoir 901, as described with regard to FIG. 10A.

Tube 1104 connects first portion 1102 and second portion 1103, thus allowing fuel to communicate between first portion 1102 and second portion 1103. The tail section 804 protrudes into first portion 1102 through hole 910, such that it makes contact with liquid fuel flowing into first portion 1102 through tube 1104.

A valve 1105 controls the flow of fuel through tube 1104. valve 1105 is made up of gate 1106 and handle 1107. Gate 1106 closes to block fuel flow through tube 1104, opens completely to allow free flow, or opens partially to allow some flow. One skilled in the art will recognize that many different types of valves can be used to provide this functionality. Handle 1107 controls the position of gate 1106, and is located on the exterior of fuel reservoir 901. In this example embodiment, handle 1107 is located on the bottom surface 1108 of fuel reservoir 901. In another embodiment, handle 1107 is located on a perimeter surface 1109 of fuel reservoir 901.

Figure 12A:
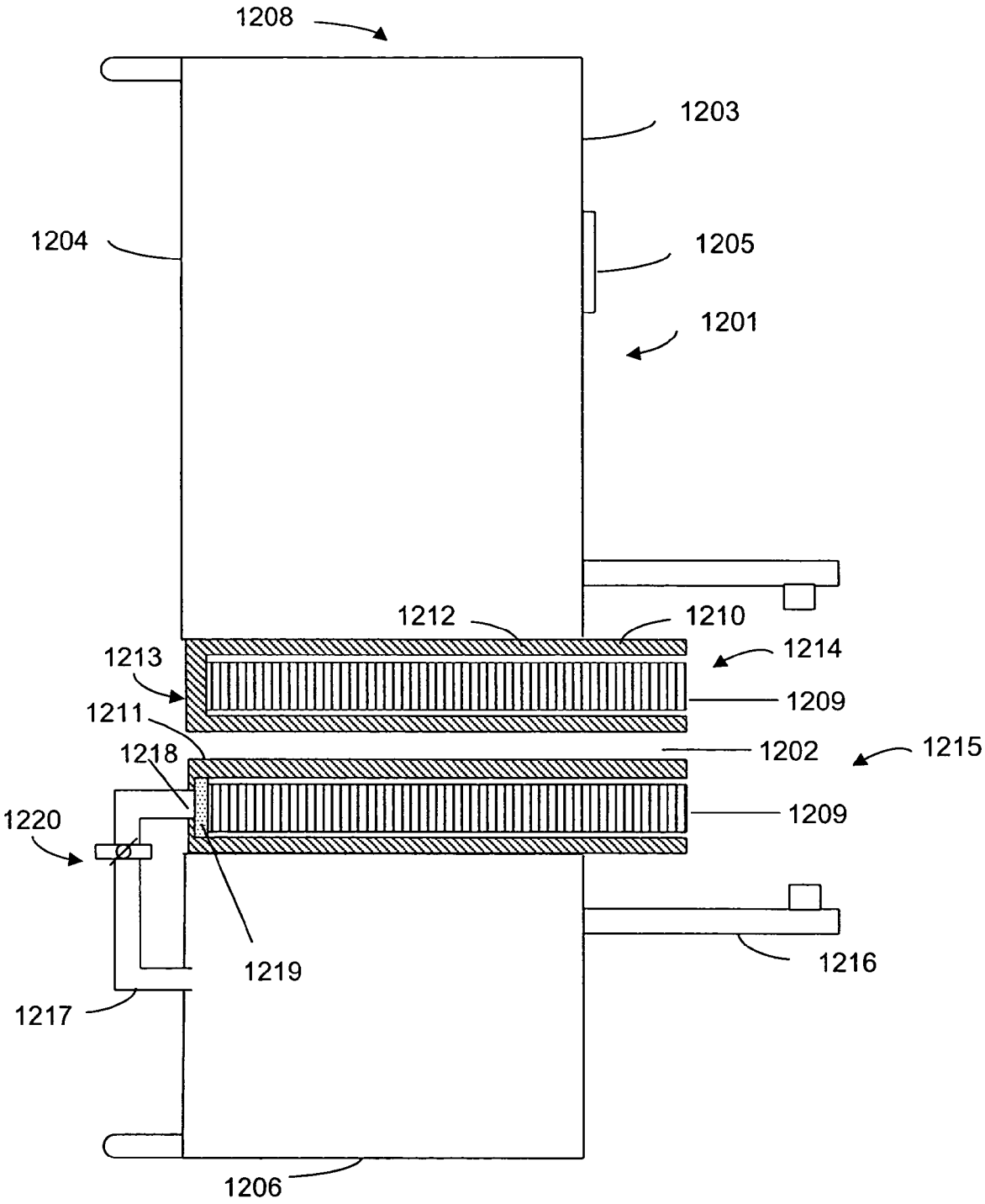
FIGS. 12A–C are side, top, and bottom views of another embodiment of the apparatus for controlling a flame.
Figure 12B:
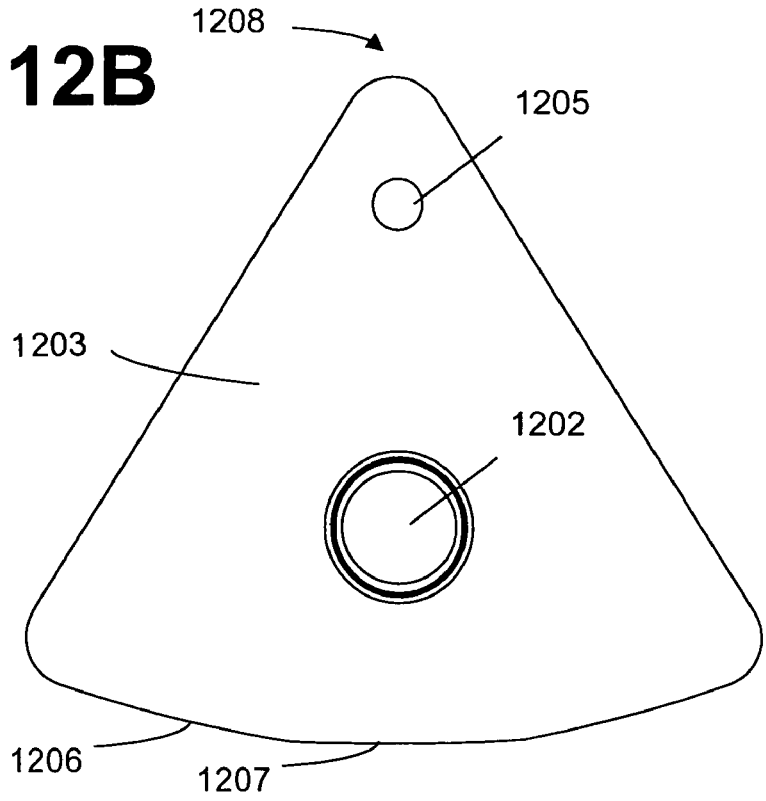
Figure 12C:
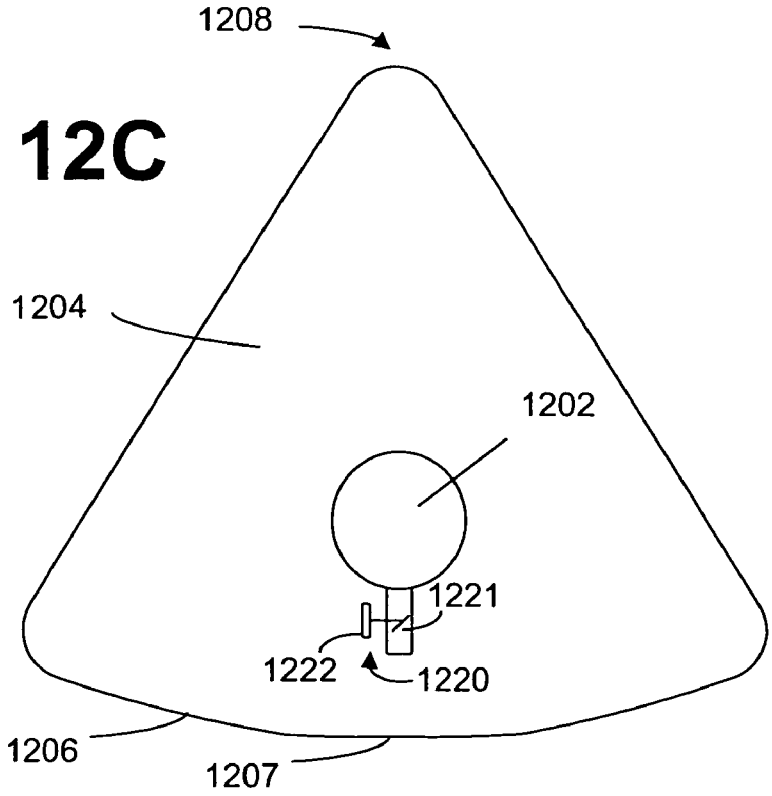

FIGS. 12A–C are side, top, and bottom views of another embodiment of the apparatus for controlling a flame. In a conventional lamp, the wick is vertical so that the flame burns "up" along the wick. In this embodiment of FIG. 12, the wick has a substantially horizontal orientation when the base is placed on a horizontal surface. Several aspects which make this embodiment suitable for either vertical or horizontal orientation will now be described.

Fuel reservoir 1201 has a hollow channel 1202 extending through it, from its front surface 1203 to its back surface 1204. Fuel reservoir 1201 is filled using cap 1205, which also seals to prevent air from entering fuel reservoir 1201. In this embodiment, cap 1205 is located on the front surface 1203, but it can be located on any surface without loss of functionality.

The apparatus is stable when resting on a horizontal surface. To this end, in the preferred embodiment the bottom surface 1206 has a flattened portion 1207. In the preferred embodiment, the dimensions of the top portion 1208 of the fuel reservoir 1201 are narrower than the bottom portion, thus providing a relatively low center of gravity to aid in stability.

Wick 1209 has a hollow center. In this preferred embodiment, the shape of wick 1209 is a hollow cylinder, with a circular cross-section. In other embodiments, the cross-section is rectangular or triangular. A portion of wick 1209 is surrounded by sleeve 1210. Sleeve 1210 is comprised of an inner wall 1211 and an outer wall 1212. Inner wall 1211 and outer wall 1212 are joined at one end, so that sleeve 1210 is closed at one end (1213) but not at the other (1214). Wick 1209 is slidably received by sleeve 1210 and the travel of wick 1209 into sleeve 1210 is stopped by the joined end 1213. Wick 1209 and sleeve 1210 combine to form wick assembly 1215.

Wick assembly 1215 is sized to be slidably received by the channel 1202. Wick assembly 1215 is affixed to the sides of fuel reservoir 1201 that define channel 1202. In this position, air flows through channel 1202 into the hollow center of wick 1209 to provide air to the flame burning on the end of wick 1209. In a preferred embodiment, the hollow center of wick 1209 is coaxial with the center of channel 1202, and the bottom of sleeve 1210 is flush with the back surface 1204 of fuel reservoir 1201.

Collar 1216 is dimensioned to surround a top portion of wick assembly 1215. Collar 1216 is slidably adjustable along the longitudinal axis of wick assembly 1215, using an adjustment mechanism (shown in FIG. 15).

Tube 1217 connects fuel reservoir 1201 to one end of sleeve 1210, passing through opening 1218 in at closed end 1213 of sleeve 1210. Opening 1218 is sealed around tube 1217 so fuel does not leak around the opening. Liquid fuel flowing through opening 1218 reaches one end of a bottom portion of wick 1209. The fuel spreads through capillary action to the other end of wick 1209, and to upper portions of wick 1209. Although sleeve 1210 is open at the end opposite the tube, fuel leakage from this end (1213) is minimal while the apparatus is in use, because wick 1209 absorbs most of the fuel.

In the example embodiment of FIG. 12, a membrane 1219 is interposed between tube opening 1218 and wick 1209. Membrane 1219 is composed of a material whose permeability to the liquid fuel in fuel reservoir 1201 varies with temperature. Membrane 1219 has the following characteristics. At room temperature, membrane 1219 is impermeable to the fuel because the pores in membrane 1219 are smaller than the fuel droplets. At a temperature slightly below the fuel's burning temperature, the pore size is unchanged, but fuel passes through membrane 1219 because the fuel's viscosity is lower (droplets are smaller). At or near the fuel's burning temperature, the pores in membrane 1219 become narrower, thus reducing the amount of fuel passing through membrane 1219.

These characteristics of membrane 1219 provide a fuel supply that is self-regulating. With less fuel seeping through membrane 1219 to supply wick 1209, the flame on wick 1209 gets smaller. As the flame gets smaller, wick 1209, sleeve 1210 and membrane 1219 get cooler. When membrane 1219 cools, the pores in membrane 1219 expand to increase the amount of fuel passing through membrane 1219.

One example of a suitable material for membrane 1219 is chemically crosslinked or radation crosslinked rubber or polymer. The crosslinks in the rubber or polymer allow it to keep its shape at increased temperatures, and during the cycles of expansion and contraction described above. One skilled in the art will recognize that other materials with similar functional characteristics can be used. One skilled in the art will also realize that the physical characteristics (pore size, etc.) which give rise to these functional characteristics will be matched to the fuel used in fuel reservoir 1201.

A valve 1220 controls the flow of fuel through tube 1217. Valve 1220 is made up of gate 1221 and handle 1222. Gate 1221 closes to block fuel flow through tube 1217, opens completely to allow free flow, or opens partially to allow some flow. One skilled in the art will recognize that many different types of valves can be used to provide this functionality. Handle 1222, located on the exterior of tube 1217, controls the position of gate 1221.

The embodiment of FIG. 12 can be used without modification in either a vertical or horizontal orientation. The horizontal orientation shown in FIG. 12 can be used while carrying the apparatus, and the features described provide a stable flame even when exposed to wind or vibrations.

Another aspect which makes this embodiment suitable for use in a horizontal orientation will now be described with respect to FIG. 13. In a conventional lamp, the wick is vertically-oriented, and the fibers making up the wick are oriented in the same vertical direction (see wick 801 and fibers 802 in FIG. 8). Fuel makes contact with the bottom of the wick, and the vertically-oriented fibers pull the fuel to the upper part of the wick through capillary action. However, in the embodiment of FIG. 12 where the wick is horizontally oriented, fibers oriented in the same direction as the wick are not optimal. In this case, the horizontal fibers do not act to pull fuel to the upper part of the wick, but instead pull fuel to one end of the wick.

Figure 13:
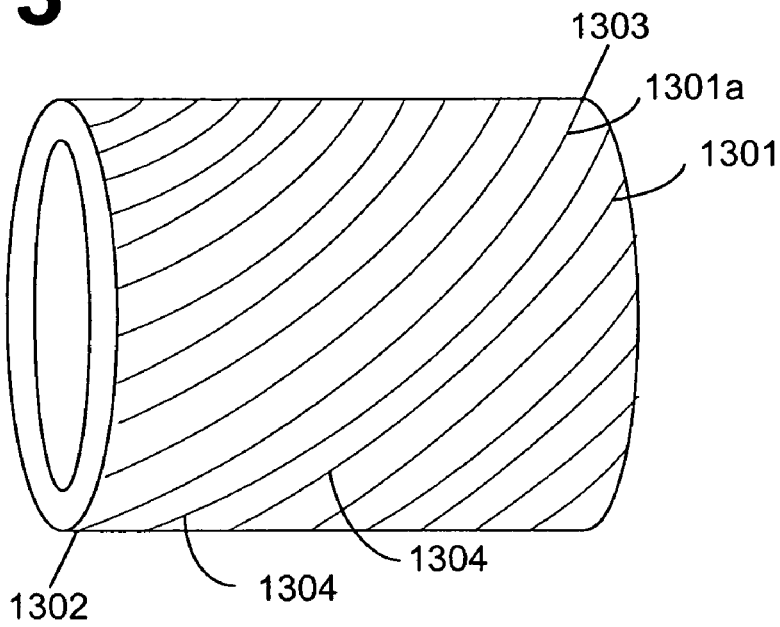
FIG. 13 is a preferred embodiment of the wick of FIG. 12.

FIG. 13 is a preferred embodiment of wick 1209, where glass fibers 1301 run in a spiral, rather than parallel to the body of the wick. In this embodiment, each glass fiber runs from a point on the bottom of wick 1209, to a point on the top of the wick 1209. For example, glass fiber 1301*a* runs from point 1302 to point 1303. Points 1302 and 1303 are on opposite sides on the cylinder. In other words, points 1302 and 1303 are spaced 180° apart on the cylinder's circular surface. Other fiber winding arrangements are possible, for example points 1302 and 1303 could be 135° apart, or 160° apart, or any other spiral arrangement so that the orientation of fibers 1301 is somewhere between horizontal and vertical.

This preferred embodiment of wick 1209 also includes another feature which works in conjunction with the membrane 1219 (see FIG. 12) to provide a self-regulating fuel supply. Flame-resistant optical fibers 1304 alternate with glass fibers 1301. The optical fibers 1304 transmit heat radiating from the flame to the membrane 1219 in an efficient manner. In this preferred embodiment, the ends of optical fibers 1304 at the flame-bearing end of wick 1209 are smooth to avoid building up of char on the surface.

Figure 14:
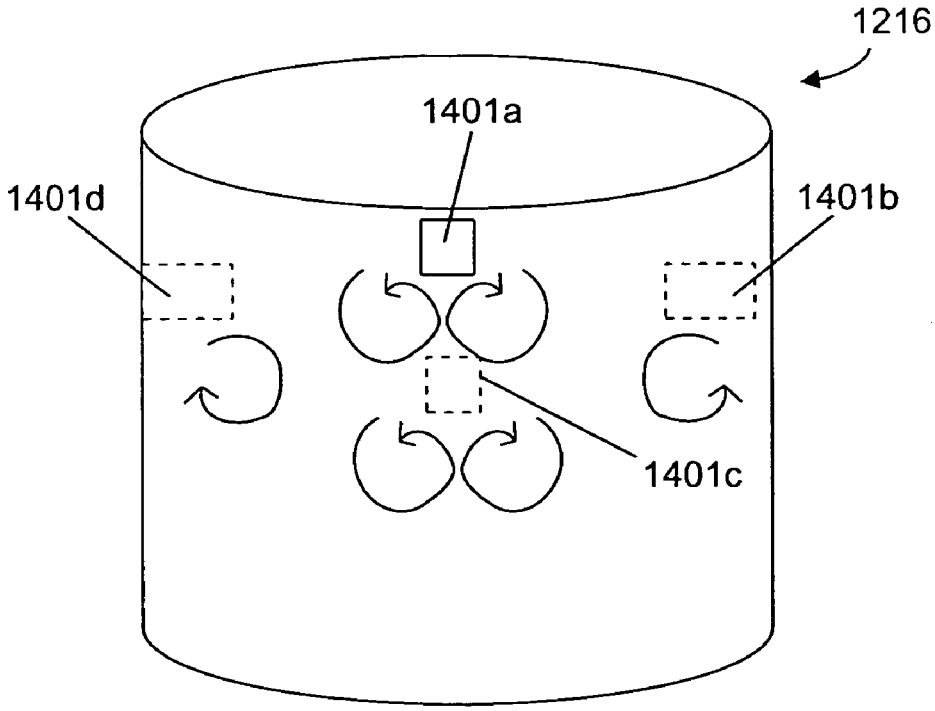
FIG. 14 is perspective view of the collar of FIG. 12.

FIG. 14 is a first portion 1102 of the collar 1216 of FIG. 12. Collar 1216 can be made of any suitable material, for example metal or glass. Collar 1216 surrounds a top portion of wick assembly 1215 (see FIG. 12). Pins 1401 are located on the inner surface of collar 1216. In this example embodiment, there are four pins 1401*a–d*, space equidistant from each other. Under windy conditions, pins 1401*a–d* disturb the air flow around the flame at the end of wick 1209, creating areas of turbulence (shown by arrows in FIG. 14). The resulting turbulence increases mixing of air and fuel vapor within the flame, thus producing more efficient combustion and less smoke. When the air around the flame is relatively still, no turbulence is created by the pins 1401*a–d*.

Figure 15A:
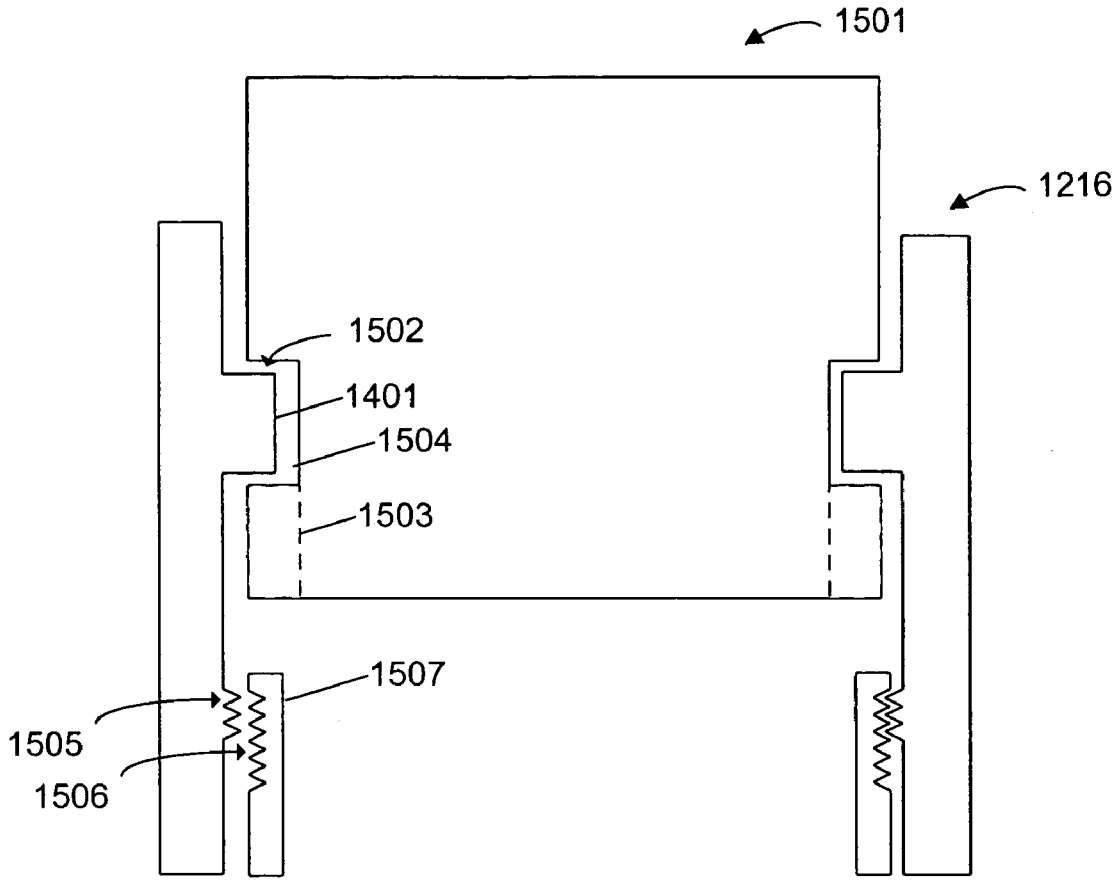
FIGS. 15A and 15B are is a side cutaway and a top cross-section view, respectinely, of a cap suitable for use with the embodiment of FIG. 12.
Figure 15B:
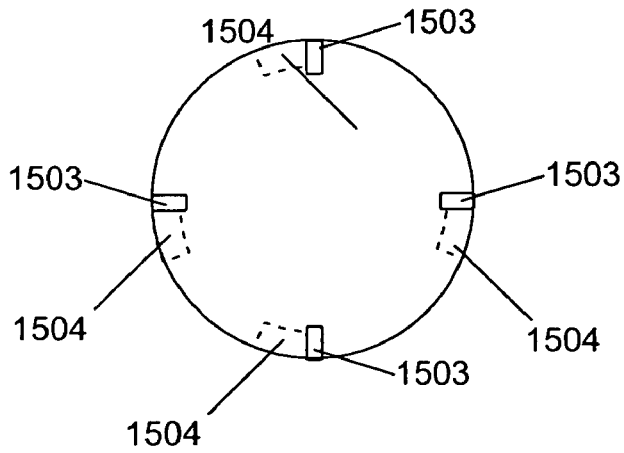

FIG. 15A is a side cutaway showing a cap 1501 in use with the embodiment of FIG. 12. FIG. 15B is a top cross-section view of cap 1501 alone. Cap 1501 is shaped to be received by collar 1216. In this example embodiment, collar 1216 is circular in cross-section, so that cap 1501 is also circular in cross-section.

Cap 1501 has notches or channels 1502 cut into its side surface, each channel 1502 mating with a pin 1401 on the inner surface of collar 1216. Each channel 1502 has a vertical leg 1503 and a horizontal leg 1504. To attach cap 1501 to collar 1216, cap 1501 is rotated so that each vertical leg 1503 aligns with one of the pins 1401. vertical leg 1503 then slides along pin 1401 until horizontal leg 1504 is reached. At this point, cap 1501 is rotated again so pins 1401 slide into horizontal leg 1504.

Cap 1501 and channels 1502 are sized for a relatively close fit with collar 1216, so that when the apparatus is used in the orientation shown in FIG. 12A, the fuel within wick assembly 1215 is contained by cap 1501 and does not leak out. In one embodiment, the bottom of cap 1501 has a rubber seal (not shown).

The inner surface of collar 1216 is threaded, and these threads 1505 mate with the threaded portion 1506 on each of a plurality of posts 1507. Posts 1507 mount on fuel reservoir 1201, inside collar 1216. The threaded portion 1506 of the post is larger than the collar threads 1505, allowing collar 1216 to be slidably adjusted along the vertical axis of wick assembly 1215. Movement of collar 1216 along this axis from bottom to top covers an increasing portion of wick assembly 1215.

The supply of air to the outer portion of wick 1209 is influenced by the position of collar 1216. When collar 1216 is at a lowered position, atmospheric air flows freely to the outer portion of wick 1209. Air is also supplied to the inner portion of wick 1209 by air channel 1202. This maximal air supply to both inner and outer portions of wick 1209 results in a flame with a maximum height. When collar 1216 is at a raised position, the flow of atmospheric air to the outer portion of wick 1209 is at least partially blocked by collar 1216, while the inner portion of wick wick 1209 receives a supply of air through air channel 1202. This reduced air supply results in a flame with a reduced height.

The foregoing description has been presented for purposes of illustration and description. It is not intended to be exhaustive or to limit the invention to the precise forms disclosed. Obvious modifications or variations are possible in light of the above teachings. The embodiments discussed, however, were chosen and described to illustrate the principles of the invention and its practical application to thereby enable one of ordinary skill in the art to utilize the invention in various embodiments and with various modifications as are suited to the particular use contemplated. All such modifications and variation are within the scope of the invention as determined by the appended claims when interpreted in accordance with the breadth to which they are fairly and legally entitled.

Therefore, having thus described the invention, at least the following is claimed:

1. An apparatus comprising:

a fuel reservoir with a front surface, a back surface, and a bottom surface having a flattened portion;

an air channel extending through the fuel reservoir between the front surface and the back surface;

a wick assembly, mounted within the air channel, comprising:

a wick with a hollow center; and a wick sleeve conforming to the wick, the wick sleeve comprising an inner wall and an outer wall, wherein the wick sleeve is adapted such that the wick is slidably received by a first end of the wick sleeve and wick travel is stopped by a second end of the wick sleeve;

a fuel tube connecting the fuel reservoir and the second end of the wick sleeve through a fuel opening in the second end of the wick sleeve, such that the wick is in fluid communication with the fuel reservoir; and a fuel valve for controlling the flow of fuel through the fuel tube, wherein the flattened portion of the fuel reservoir is adapted to position the wick assembly parallel to a horizontal surface when the flattened portion rests on the horizontal surface and the top portion of the reservoir is sized narrower than the bottom portion.

2. The apparatus of claim 1, wherein the wick comprises a plurality of glass fibers wound in a spiral pattern, wherein the spiral pattern is oriented at an angle to the wick.

3. The apparatus of claim 1, further comprising:

a membrane located between the second end of the wick sleeve and the wick, in close proximity to the fuel opening and in contact with the wick.

4. The apparatus of claim 1, further comprising:

a semi-permeable membrane located between the second end of the wick sleeve and the wick, in close proximity to the fuel opening and in contact with the wick, the membrane containing pores which decrease in size as the temperature of the membrane increases.

5. The apparatus of claim 1, wherein the hollow center of the wick is coaxial with the air channel.

6. The apparatus of claim 1, wherein the second end of the wick sleeve is flush with the back surface of reservoir.

7. The apparatus of claim 1, wherein the fuel valve comprises a handle and a gate, wherein the gate is located within the fuel tube.

8. The apparatus of claim 1, wherein the fuel valve comprises a handle and a gate, wherein the gate is located within the fuel tube and the handle is located on the exterior of the fuel tube, and is operable to open and close the gate.

9. The apparatus of claim 1, wherein the wick comprises a plurality of glass fibers.

10. The apparatus of claim 1, wherein the wick comprises a plurality of optical fibers.

11. The apparatus of claim 1, wherein the wick comprises a plurality of glass oriented at an angle to the wick.

12. The apparatus of claim 1, wherein the wick comprises a plurality of glass fibers wound in a spiral pattern.

13. The apparatus of claim 1, wherein the wick comprises a plurality of glass fibers wound in a spiral pattern, wherein the spiral pattern is oriented at an angle to the wick.

* * * * *